US010414467B2

(12) United States Patent
Van Den Ende et al.

(10) Patent No.: US 10,414,467 B2
(45) Date of Patent: Sep. 17, 2019

(54) ANCHOR WITH IMPROVED PENETRATION PROPERTIES

(71) Applicant: Stevlos B.V., Capelle aan den Ijssel (NL)

(72) Inventors: David Peter Van Den Ende, Zuid-Beijerland (NL); Victor Maria Wilhelm Gerard Remmers, Krimpen aan den Ijssel (NL)

(73) Assignee: STEVLOS B.V. (NL)

( * ) Notice: Subject to any disclaimer, the term of this patent is extended or adjusted under 35 U.S.C. 154(b) by 0 days.

(21) Appl. No.: 15/771,984

(22) PCT Filed: Sep. 30, 2016

(86) PCT No.: PCT/NL2016/050670

§ 371 (c)(1),
(2) Date: Apr. 27, 2018

(87) PCT Pub. No.: WO2017/074177

PCT Pub. Date: May 4, 2017

(65) Prior Publication Data

US 2018/0339749 A1 Nov. 29, 2018

(30) Foreign Application Priority Data

Oct. 27, 2015 (NL) ..... 2015665

(51) Int. Cl.
*B63B 21/32* (2006.01)
*B63B 21/34* (2006.01)
(Continued)

(52) U.S. Cl.
CPC ..... *B63B 21/34* (2013.01); *B63B 21/26* (2013.01); *B63B 21/32* (2013.01); *B63B 21/50* (2013.01); *B63B 2021/262* (2013.01)

(58) Field of Classification Search
CPC ..... B63B 21/24; B63B 21/26; B63B 21/32; B63B 21/34; B63B 2021/24; B63B 2021/26; B63B 2021/262; B63B 2021/265
(Continued)

(56) References Cited

U.S. PATENT DOCUMENTS 4,577,581 A * 3/1986 Puech ..... B63B 21/34 114/294
4,995,326 A * 2/1991 van den Haak ..... B63B 21/34 114/301
(Continued)

FOREIGN PATENT DOCUMENTS

| | | | |
|---|---|---|---|
| AU | 2005200544 | 8/2005 | B63B 21/34 |
| EP | 0049544 | 4/1982 | B63B 21/32 |
| EP | 0196801 | 10/1986 | B63B 21/42 |

OTHER PUBLICATIONS

International Preliminary Report on Patentability issued in application No. PCT/NL2016/050670, dated May 1, 2018 (6 pgs).
(Continued)

*Primary Examiner* — Daniel V Venne
(74) *Attorney, Agent, or Firm* — Hayes Soloway P.C.

(57) ABSTRACT

Disclosed is an anchor having a fluke, a shank that is connected to the fluke, and a coupling to attach the fluke to an anchor line or anchor chain, wherein the shank has two shank legs each having a straight shank plate with an outer surface that extend on the opposite sides of the plane of symmetry of the anchor and that diverge from the coupling towards the fluke, wherein the fluke has two straight penetration plates with a top surface on the opposite sides of the plane of symmetry of the anchor, wherein the orientation of the outer surfaces with respect to the top surfaces is specified
(Continued)

by three angles under narrow ranges to provide excellent penetration properties and an excellent holding capacity.

11 Claims, 5 Drawing Sheets

(51) Int. Cl.
*B63B 21/26* (2006.01)
*B63B 21/50* (2006.01)

(58) Field of Classification Search
USPC ..... 114/394, 295, 301, 309
See application file for complete search history.

(56) References Cited

U.S. PATENT DOCUMENTS 5,640,921 A * 6/1997 Van Den Haak ..... B63B 21/22 114/294
6,082,284 A * 7/2000 McCabe ..... B63B 21/26 114/301
6,901,878 B2 * 6/2005 Degenkamp ..... B63B 21/26 114/295
7,467,597 B2 * 12/2008 Degenkamp ..... B63B 21/26 114/303

OTHER PUBLICATIONS

International Search Report and Written Opinion issued in application No. PCT/NL2016/050670, dated Nov. 21, 2016 (9 pgs).

* cited by examiner

ANCHOR WITH IMPROVED PENETRATION PROPERTIES

BACKGROUND

The invention relates to an anchor comprising a fluke, a shank having two shank legs that are connected to the fluke, and a coupling to attach the shank to an anchor line or anchor chain.

These type of anchors are used for heavy maritime or offshore objects, such as a drilling platform. There is a continuous need for anchors for heavy maritime applications that stably penetrate the anchoring ground and provide a constant holding capacity during its use.

It is an object of the present invention to provide an anchor for heavy maritime or offshore objects of the above-mentioned type having both good penetration and holding properties in the anchoring ground.

SUMMARY OF THE INVENTION

The invention provides an anchor comprising a fluke, a shank that is connected to the fluke, and a coupling to attach the shank to an anchor line or anchor chain, wherein the shank comprises two shank legs each having a straight shank plate with an outer surface that extend on the opposite sides of the plane of symmetry of the anchor and that diverge from the coupling towards the fluke, wherein the fluke comprises two straight penetration plates with a top surface on the opposite sides of the plane of symmetry of the anchor, wherein the penetration plates are under an angle to each other, wherein the penetration plates extend outwards from the shank legs and obliquely downwards with respect to the direction from the coupling towards the fluke, wherein the top surfaces or the notional extensions thereof intersect each other along a notional straight datum line that extends in the plane of symmetry, wherein a notional datum plane is defined that extends perpendicular to the plane of symmetry and that intersects the plane of symmetry of the anchor along the datum line, wherein for the shank plates a notional first intersection plane and a notional second intersection plane are defined, wherein the first intersection plane is parallel to the datum plane and perpendicular to the plane of symmetry, and wherein the second intersection plane is perpendicular to the datum plane and perpendicular to the plane of symmetry, wherein the first intersection plane intersects the outer surfaces of the shank plates along a first intersection line and the second intersection plane intersects the outer surfaces of the shank plates along a second intersection line, wherein the first intersection line is under a first angle with the plane of symmetry of 6-8 degrees, the second intersection line is under a second angle with the datum plane of 66-76 degrees and the top surfaces of the penetration plates are under a third angle with the datum plane of 10-20 degrees.

It has been found that the anchor having the geometry as specified within the combined three small ranges for the first angle, the second angle and the third angle provides excellent penetration properties. The specified anchor stably penetrates the anchoring ground without intermediate break-outs in its penetration trajectory, leading to an excellent holding capacity during its use.

In an embodiment the fluke plates extend on both sides of its nearest shank leg, having the top surface on both sides of that shank leg in the same plane. These top surfaces between the shank legs under the same specified third angle provide additional penetration capacity and holding capacity during the use of the anchor.

In an embodiment the fluke plates each comprise an inner penetration edge and an outer penetration edge, wherein the penetration edges converge towards two penetration tips of the fluke to induce fast initial penetration of the fluke into the anchoring ground.

In an embodiment thereof the coupling extends in the projection perpendicular to the datum plane beyond the penetration tips of the fluke.

In an embodiment the fluke comprises two girders extending below and connected to the penetration plates, wherein the shank legs are connected with the girders. The girders transfer the high penetration forces that are exerted to the shank to the penetration plates.

In an embodiment the penetration tips are located at a distal end of the girders.

In an embodiment the girders extend parallel to the plane of symmetry, whereby they can contribute in maintaining the anchor on it stable track during the penetration into the anchoring ground.

In an embodiment the shank legs each comprise a straight middle section with the straight shank plates between the coupling and the fluke, and a base section with a base plate that is oriented under an angle with respect to the shank plates via a deflection line, wherein the main planes of the base plates and the girders extend parallel to or in line with each other.

In an embodiment the shank legs comprise an end eye at the coupling, wherein the end eye comprises an eye plate that is under an angle with respect to the shank plates via a deflection line, wherein the eye plates extend parallel to each other.

In an embodiment the fluke comprises reinforcement plates below the penetration plates that are connected to each other along their edges to form a rigid hollow box.

The invention further relates to a computer-readable medium having computer-executable instructions adapted to cause a 3D printer to print an anchor according to the invention.

The various aspects and features described and shown in the specification can be applied, individually, wherever possible. These individual aspects, in particular the aspects and features described in the attached dependent claims, can be made subject of divisional patent applications.

BRIEF DESCRIPTION OF THE DRAWINGS

The invention will be elucidated on the basis of an exemplary embodiment shown in the attached drawings, in which.

DETAILED DESCRIPTION OF THE INVENTION

Figure 1:
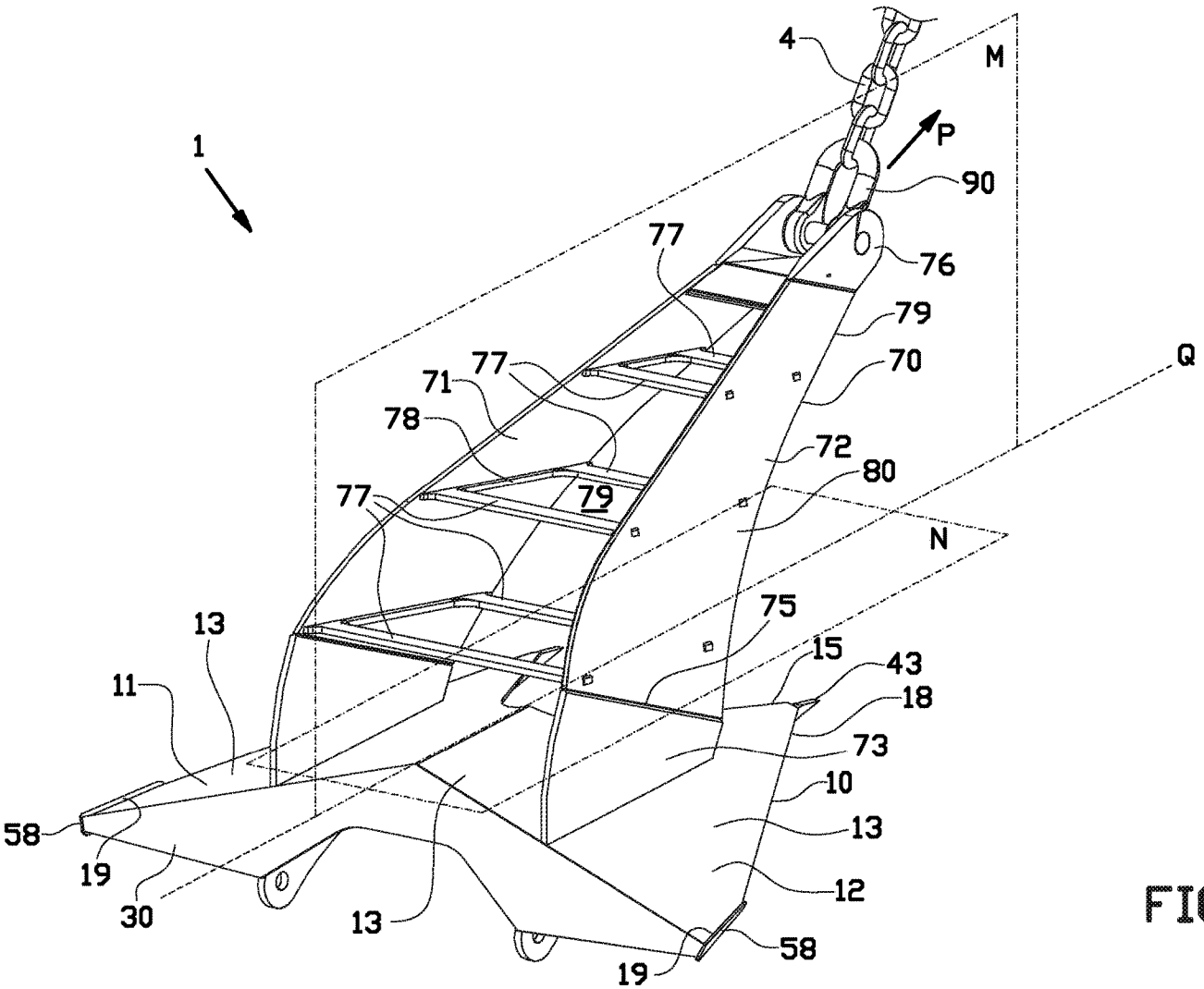
FIG. 1 is an isometric side view of an anchor according to the invention.

FIGS. 1-5 show an anchor 1 according to an embodiment of the invention. The anchor 1 is intended for anchoring heavy maritime or offshore objects, such as a drilling platform in a subsea anchoring ground, for a long period of use that may last many years. The anchor 1 has a typical deadweight of 1-50 tons.

The anchor 1 comprises a fluke 10 and a shank 70 which with respect to the fluke 10 inclines obliquely forward and which at its end is provided with a shackle 90 by which the anchor 1 is connected to an anchor line or anchor chain 4. The anchor 1 is substantially symmetrical with respect to its plane of symmetry M. The anchor 1 is formed for in a forward penetration direction P being introduced into the anchoring ground substantially parallel to the plane of symmetry M.

The fluke 10 is a hollow box built up using steel plate members that are connected to each other by welding. As best shown in FIG. 1 the fluke 10 comprises two straight penetration plates 11, 12 that are oriented obliquely with respect to the plane of symmetry M. The straight top surfaces 13 of the penetration plates 11, 12 that are directed towards the shank 70, or the notional extensions thereof outside the penetration plates 11, 12, intersect each other along a notional straight reference line or datum line shown in phantom at Q that extends in the plane of symmetry shown in phantom at M. For reference to the geometric features of the shank 70 with respect to the fluke 10, a notional datum plane shown in phantom at N is defined for the anchor 1. The datum plane N extends perpendicular to the plane of symmetry M of the anchor 1 and intersects the plane of symmetry M along the datum line Q.

Figure 4:
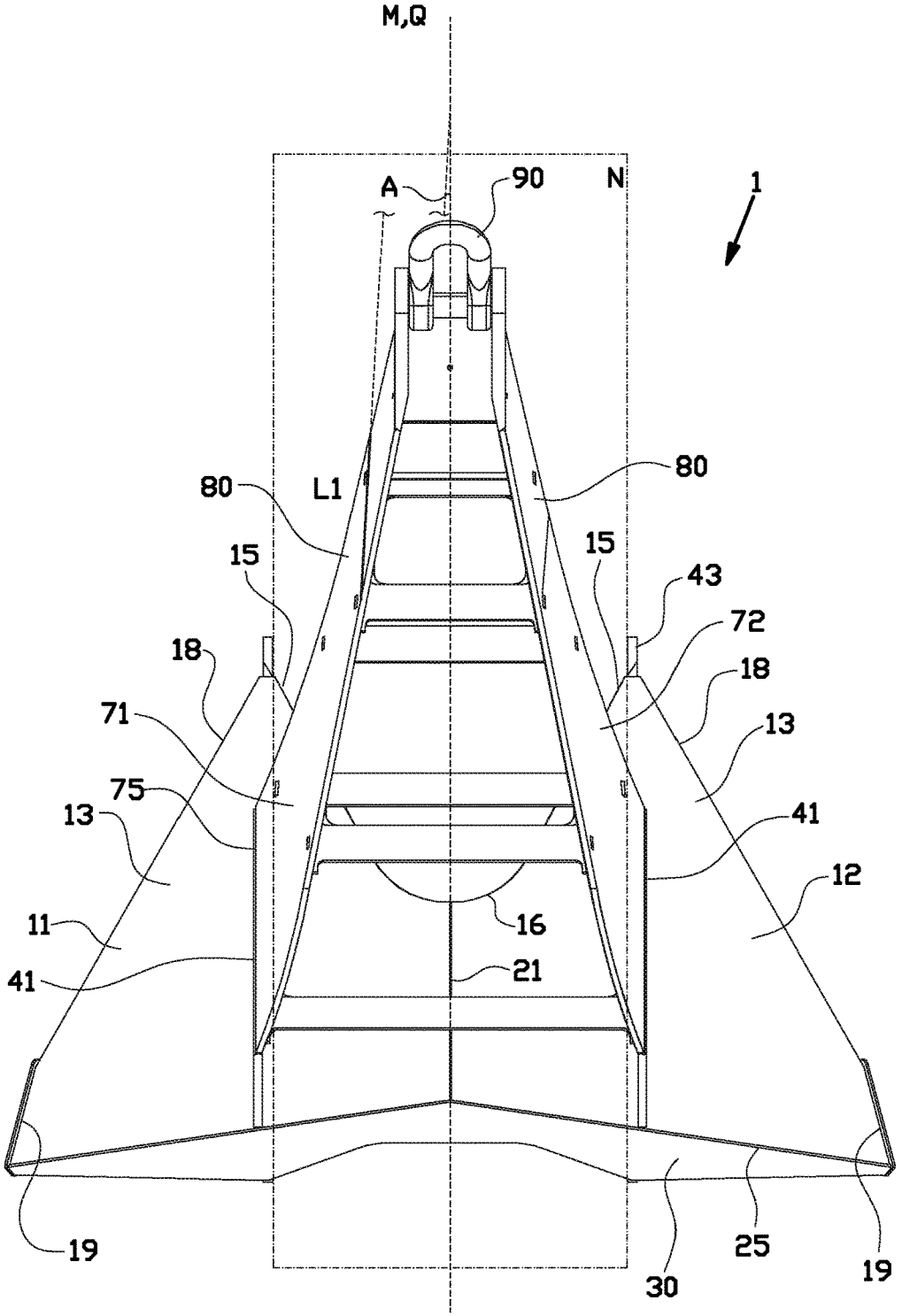
FIGS. 4 and 5 are a top view and a back view parallel to the plane of symmetry of the anchor of FIG. 1.

As best shown in FIG. 4, the penetration plates 11, 12 each have a straight inner penetration edge 15 and a straight outer penetration edge 18 that are directed towards each other in the penetration direction P. The straight inner penetration edge 15 and the straight outer penetration edge 18 extend are under the same angle with respect to the plane of symmetry M. The straight inner penetration edges 15 symmetrically merge into each other via a circularly curved penetration edge 16. As from the middle of the curvature 16 the penetration plates 11, 12 comprise straight upper fluke edges 21 that are welded together along the datum line Q. The outer penetration edges 18 merge into a shorter outer fluke edge 19 that extends under a smaller angle with respect to the plane of symmetry M. In the direction parallel to the datum line Q the outer fluke edges 19 extend backwardly beyond the shank 70. The penetration plates 11, 12 each comprise a straight rear fluke edge 25 extending between the upper fluke edges 21 and the outer fluke edges 19. The rear fluke edges 25 are oriented oblique to the datum line Q, having their merging ends located forwards in the penetration direction P.

Figure 2:
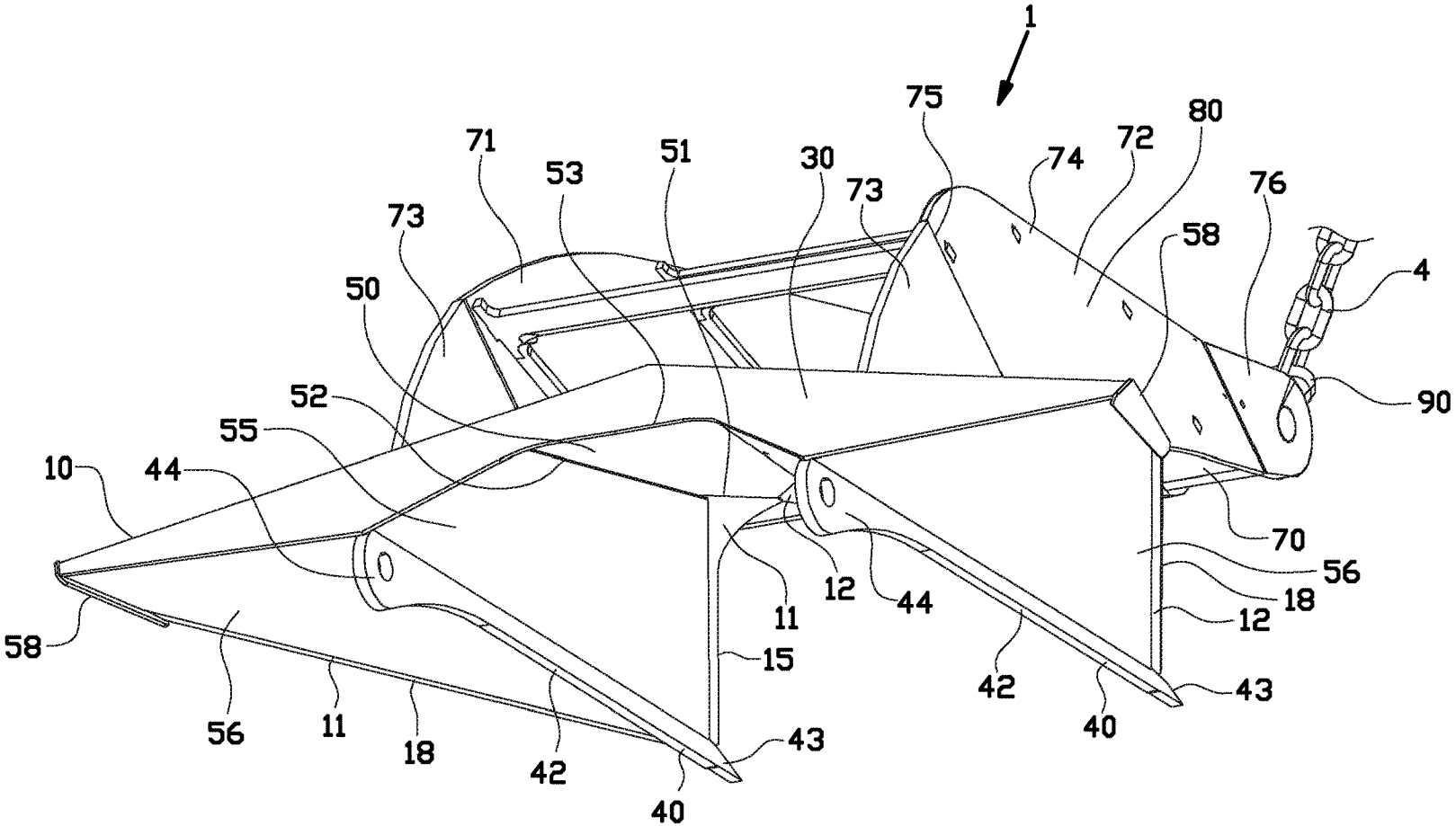
FIG. 2 is an isometric bottom view of the anchor of FIG. 1.
Figure 3:
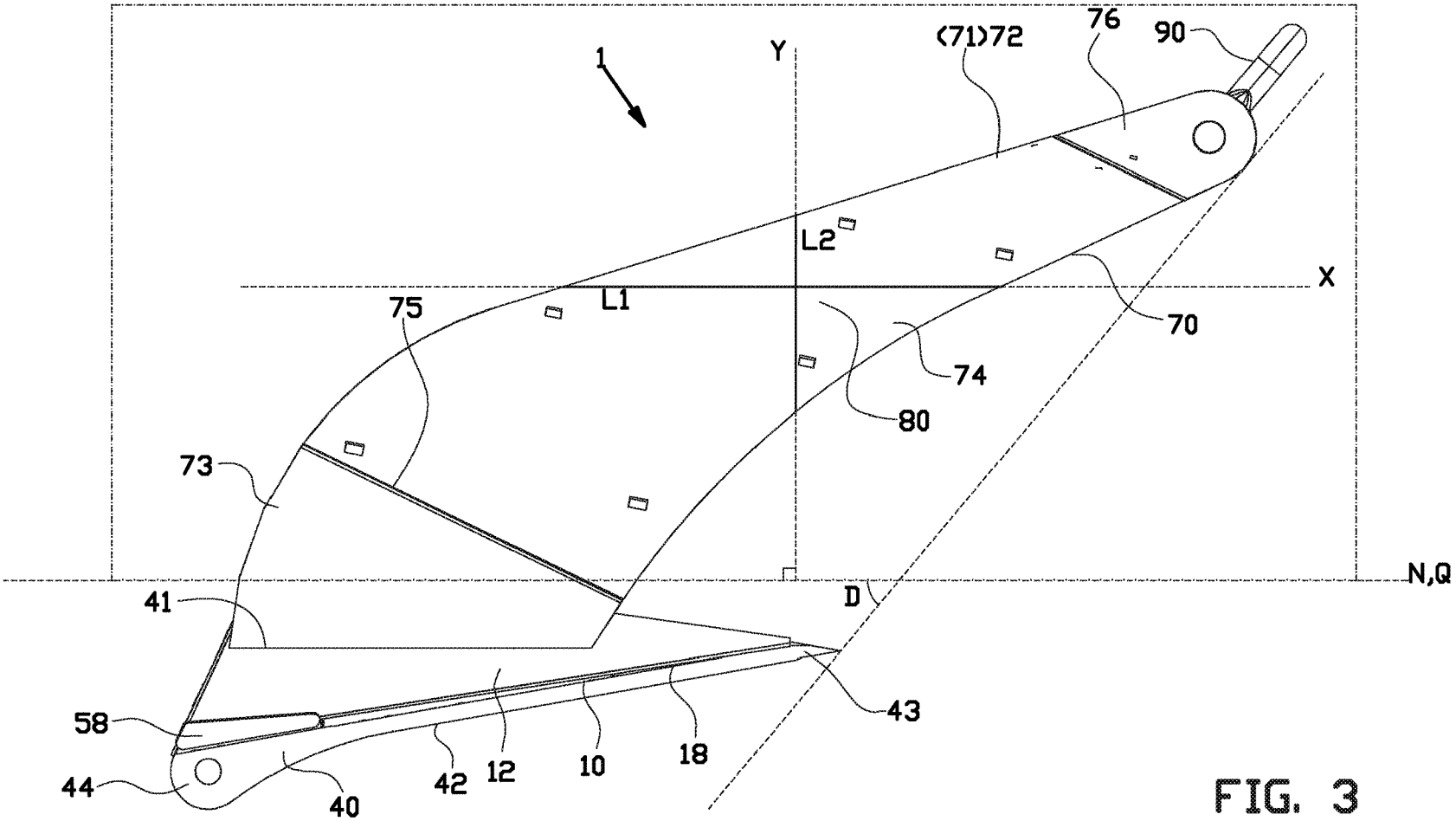
FIG. 3 is a side view perpendicular to the plane of symmetry of the anchor of FIG. 1.

As best shown in FIGS. 2 and 3 the fluke 10 comprises two girder plates 40 extending parallel to the plane of symmetry M. The girder plates 40 pass through slots 41 in the penetration plates 11, 12 and have a straight lower edge 42 extending freely at the bottom side of the fluke 10. At the front side the lower edges 42 merge into a penetration tip 43 that may be of a hardened steel. At the rear side the lower edge 42 merge into a hoisting eye 44.

As best shown in FIG. 2, the fluke 10 comprises a central stiffening plate 50 extending perpendicular to the plane of symmetry M. The central stiffening plate 50 extends below the penetration plates 11, 12 and are spaced apart therefrom except for its front edge 51 near the curved penetration edge 16 were it is welded thereto such that the curved penetration edge 16 projects from the central stiffening plate 50.

As best shown in FIG. 2, the fluke 10 comprises two straight inner stiffening plates 55 between the central stiffening plate 50 and the girder plates 40. The inner stiffening plates 55 are welded to the side edges 52 of the central stiffening plates 55. The inner stiffening plates are welded to the penetration plates 11, 12 in a recessed position and parallel to the straight inner penetration edges 15 thereof. The inner stiffening plates are welded to the girder plates 40 in a recessed position and parallel to the straight lower edge 42 of the girder plates 40.

As best shown in FIG. 2, the fluke 10 comprises two straight outer stiffening plates 56 extending upwards from the girder plates 40 towards the penetration plates 11, 12. The outer stiffening plates 56 are welded to the penetration plates 11, 12 in a recessed position and parallel to the straight outer penetration edges 18 thereof. The outer stiffening plates 56 are welded to the girder plates 40 in a recessed position and parallel to the straight lower edge 42 of the girder plates 40.

The fluke 10 comprises a straight rear stiffening plate 57 having an outer contour that follows the rear edges of the penetration plates 11, 12, the central stiffening plate 50, the inner stiffening plates 55 and the outer stiffening plates 56. The rear stiffening plate 57 is welded thereto along its outer contour. In its upward direction the rear stiffening plate 57 is oriented obliquely forwards with respect to the datum plane N. The fluke 10 comprises two straight stabiliser plates 58 that close off the hollow fluke 10 along the outer edges 19 of the penetration plates 11, 12.

The shank 70 is built up using steel shank plate members 80 that are connected to each other by, welding. The shank 70 comprises two shank legs 71, 72 that are symmetric with respect to the longitudinal plane of symmetry M. The shank legs 71, 72 each comprise a straight base section 73 that is connected to, welded to or forms one unity with the straight girder plates 40. The main plane of the base section 73 extends parallel to or is in line with the main plane of the girder plates 40. The shank legs 71, 72 comprise a. straight middle section 74 that is oriented under an angle with respect to the base section 72 via a deflection line 75. The middle section has a tapering and curved outline. In particular it has a concave curved front edge 79 between the fluke 10 and. the shackle 90, having its smallest radius at the side of the fluke 70. The shank legs 71, 72 each comprise and an end eye 76 with a hole to couple with the shackle 90. The middle sections 74 are rigidly connected to each other with multiple parallel rods 77. Pairs of the parallel rods 77 form part of a framework 78 with a central hole 79. The parallel rods 77 can thereby be welded to the middle sections 74 in pairs by welding one framework 78. In a projection perpendicular to the datum plane N, the end eye 76 for the shackle 90 extends beyond the penetration tips 43 in the penetration direction P.

Figure 5:
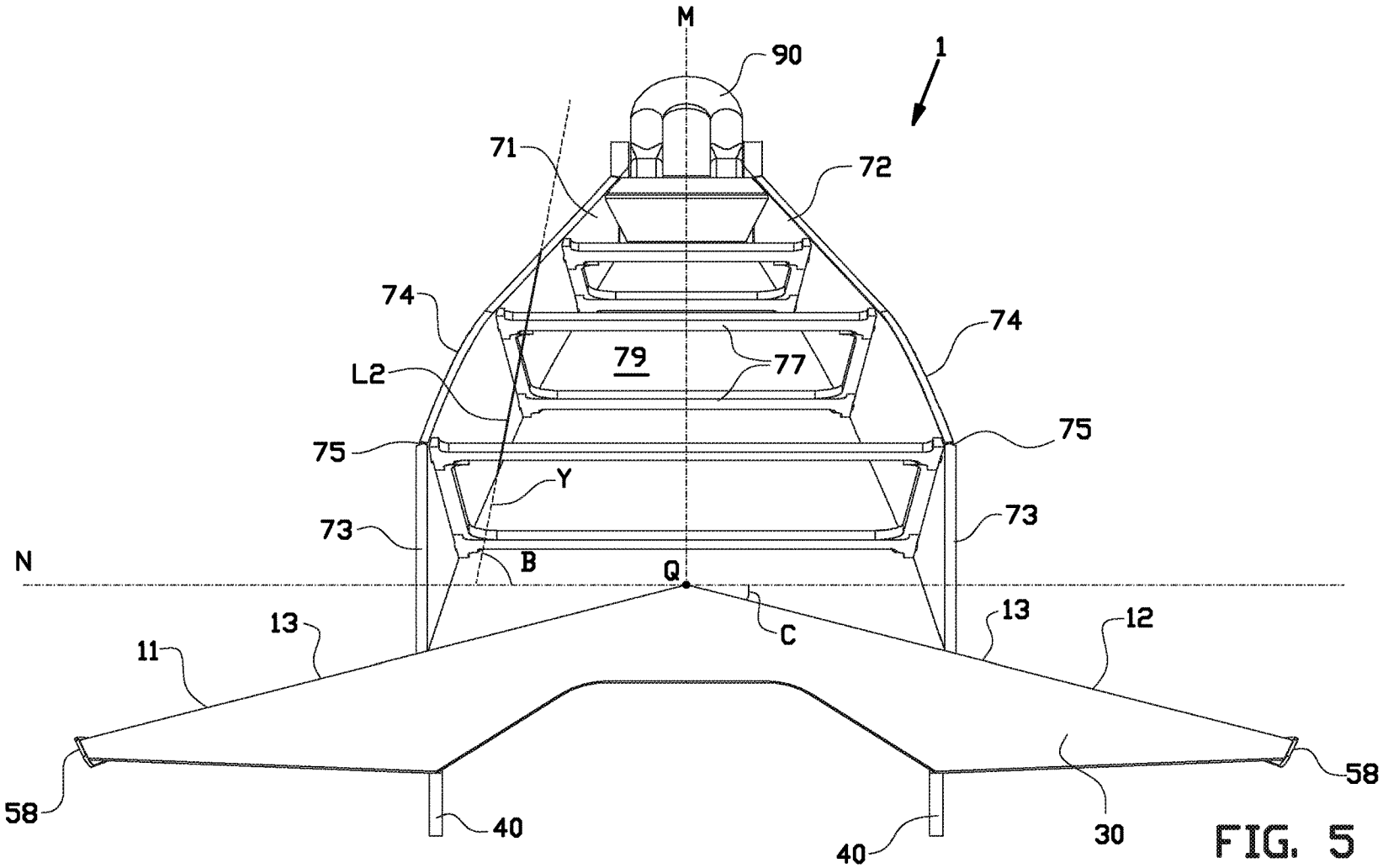

The geometrical orientation of the outer surfaces of the middle sections 74 of the shank 70 are well defined with respect to the top surfaces 13 of the penetration plates 11, 12 using the datum plane N. Reference is made to FIG. 3, in which a notional first intersection plane X and a notional second intersection plane Y through the middle sections of the shank legs 71, are indicated. The first intersection plane X extends parallel to the datum plane N and perpendicular to the plane of symmetry M. The second intersection plane Y extends perpendicular to the datum plane N and perpendicular the plane of symmetry M. The first intersection plane X defines a first intersection line L1 through each of the middle sections 74. The second intersection plane Y defines a second intersection line L2 through each of the middle sections 74. As shown in FIG. 4, the first intersection lines L1 converge in the direction from the fluke 10 towards the end eye 76 and are under a first angle A with respect to the plane of symmetry M. As shown in FIG. 5, the second intersection lines L2 converge in the direction from the fluke 10 towards the end eye 76 and are under a second angle B with respect to the datum plane N. The straight top surfaces 13 of the penetration plates 11, 12 are under a third angle C with respect to the datum plane N. When the anchor 1 is positioned onto an anchoring ground, it initially stably contracts the anchoring ground at the penetration tips 43 and the end eyes 76. In FIG. 3 the anchoring ground plane G is schematically indicated. The initial penetration angle D is defined between the datum plane N and the ground plane G.

It has been found that the anchor 1 according to the invention has both excellent penetration properties and excellent holding capacity when particular geometric values of the fluke 10 and the shank 70 are applied. The first angle A is 6-8 degrees, preferably about 7 degrees. The second angle B is 66-76 degrees, preferably about 75.7 degrees. The third angle C is 10-20 degrees, preferably about 15 degrees. The fourth angle D is 40-60 degrees, preferably about 50 degrees. Parallel to the datum plane N, in the penetration direction P, the distance between the penetration tips 43 and the axis of the shackle 90 is 50-60% of the end-to-end length of the fluke 10 in that direction. When the anchor 1 penetrates the anchoring ground, the curved front edges 79 of the middle sections 74 are the first intersection or digging contact therewith, followed by the specified, slightly wedging outer surfaces of the middle sections 74 and the specified, highly wedging top surfaces 13 of the penetration plates 11, 12. It has been found that due to this typical orientation of the middle sections 74 with respect to the penetration plates 11, 12, the local sheer tensions induced thereby inside the adjacent anchoring ground remains below the breakout threshold. Thereby the anchor 1 stably continues to penetrate the anchoring ground in direction P until it delivers the prescribed holding capacity.

It is to be understood that the above description is included to illustrate the operation of the preferred embodiments and is not meant to limit the scope of the invention. From the above discussion, many variations will be apparent to one skilled in the art that would yet be encompassed by the scope of the present invention.

The invention claimed is:

1. An anchor comprising a fluke, a shank that is connected to the fluke, and a coupling to attach the shank to an anchor line or anchor chain, wherein the shank comprises two shank legs each having a straight middle section with an outer surface that extends on opposite sides of a plane of symmetry of the anchor and that diverge from the coupling towards the fluke, wherein the fluke comprises two straight penetration plates with a top surface on opposite sides of the plane of symmetry of the anchor, wherein the two straight penetration plates are at an angle to each other, wherein the two straight penetration plates extend outwards from sides of the shank legs and obliquely downwards with respect to a direction from the coupling towards the fluke, wherein top surfaces intersect each other along a straight datum line that extends in the plane of symmetry, wherein a datum plane is defined that extends perpendicular to the plane of symmetry and that intersects the plane of symmetry of the anchor along the straight datum line, wherein for the straight middle section a first intersection plane and a second intersection plane are defined, wherein the first intersection plane is parallel to the datum plane and perpendicular to the plane of symmetry, and wherein a second intersection plane is perpendicular to the datum plane and perpendicular to the plane of symmetry, wherein the first intersection plane intersects the outer surfaces of the straight middle section along a first intersection line and the second intersection plane intersects the outer surfaces of the straight middle section along a second intersection line, wherein the first intersection line is at a first angle with respect to the plane of symmetry of 6-8 degrees, the second intersection line is at a second angle with respect to the datum plane of 66-76 degrees and the top surfaces of the penetration plates are at a third angle with respect to the datum plane of 10-20 degrees.

2. The anchor according to claim 1, wherein the penetration plates extend on both sides of the shank legs, having a top surface on both sides of the shank legs in a same plane.

3. The anchor according to claim 1, wherein the two straight penetration plates each comprise an inner penetration edge and an outer penetration edge, wherein the inner and the outer penetration edges converge towards two penetration tips of the fluke.

4. The anchor according to claim 3, wherein in a projection perpendicular to the datum plane the coupling extends beyond the two penetration tips of the fluke.

5. The anchor according to claim 1, wherein the fluke comprises two girders extending below and connected to the two straight penetration plates, wherein the shank legs are connected with the girders.

6. The anchor according to claims 1, wherein the two straight penetration plates each comprise an inner penetration edge and an outer penetration edge, wherein the inner and outer penetration edges converge towards two penetration tips of the fluke, and wherein the fluke comprises two girders extending below and connected to the two straight penetration plates, wherein the shank legs are connected with the girders, wherein the two penetration tips of the fluke are located at distal ends of the two girders.

7. The anchor according to claim 5, wherein the two girders extend parallel to the plane of symmetry.

8. The anchor according to claim 1, wherein the fluke comprises two girders extending below and connected to the two straight penetration plates, wherein the shank legs are connected with the girders, wherein the shank legs each comprise a base section with a base plate that is oriented at an angle with respect to the straight middle section via a deflection line, wherein main planes of each of the base plates and the girders extend parallel to or in line with each other.

9. The anchor according to claim 1, wherein the shank legs each comprise an end eye at the coupling, wherein each end eye comprises an eye plate that is at an angle with respect to the straight middle section via a deflection line, wherein the eye plates of the end eyes extend parallel to each other.

10. The anchor according to claim 1, wherein the fluke comprises reinforcement plates below the penetration plates that are connected to each other along edges of the two straight penetration plates to form a rigid hollow box.

11. The anchor according to claim 6, wherein the girders extend parallel to the plane of symmetry.

* * * * *